US006189732B1

(12) United States Patent
Althaus et al.

(10) Patent No.: US 6,189,732 B1
(45) Date of Patent: Feb. 20, 2001

(54) GOLF BALL CARRIER AND DISPENSER

(76) Inventors: Douglas J. Althaus, 6767 Rutland Rd., Temperence, MI (US) 48182; Daniel J. Althaus, 1107 Hawk St., Toledo, OH (US) 43612

( * ) Notice: Under 35 U.S.C. 154(b), the term of this patent shall be extended for 0 days.

(21) Appl. No.: 09/293,466

(22) Filed: Apr. 14, 1999

Related U.S. Application Data

(60) Provisional application No. 60/082,851, filed on Apr. 24, 1998.

(51) Int. Cl.[7] ..... A47F 1/04

(52) U.S. Cl. ..... 221/155; 221/185; 221/279; 221/309; 221/312 R

(58) Field of Search ..... 221/309, 307, 221/312 R, 312 C, 185, 279, 155, 251

(56) References Cited

U.S. PATENT DOCUMENTS 2,366,448 * 1/1945 Greene et al. ..... 221/279
2,445,026 * 7/1948 Frank ..... 221/279 X
3,272,411 * 9/1966 Hanson ..... 221/279 X
4,299,345 * 11/1981 Lanzl ..... 221/309 X
5,060,996 * 10/1991 Garnes ..... 221/309 X
5,554,077 * 9/1996 Coles ..... 221/307 X

* cited by examiner

*Primary Examiner*—David H. Bollinger
(74) *Attorney, Agent, or Firm*—Charles F. Schroeder

(57) ABSTRACT

A golf ball carrier and dispenser in the form of a tube in which balls are stacked and biased to one end by spring action where an end opening smaller than the balls restrains the endmost ball from release. A side dispensing opening for release of ball is located adjacent the end of the tube so that when pressure is applied through the end opening, the endmost ball of the stack can be pushed downwardly and toward the exit opening for release of the endmost ball over the next underlying ball in the stack.

16 Claims, 2 Drawing Sheets

GOLF BALL CARRIER AND DISPENSER

This application claims the benefit of U.S. provisional application 60/082,851 filed Apr. 24, 1998.

BACKGROUND OF THE INVENTION

A golfer, during a golf game frequently requires a replacement ball for the ball being played for reasons such as club impact damage to the ball being played, or that the ball is lost, or the ball because of use loses it resiliency. In such instances, a replacement ball is usually drawn from the ball pocket of the golf bag or might be carried as an extra ball in the golfer's pocket. Regardless of the reason the replacement ball is usually not as conveniently and comfortably available as it can be with the present invention.

BRIEF SUMMARY OF THE INVENTION

According to the present invention, a convenient golf ball carrier and dispenser is provided in the form of a tube in which a series of golf balls can be stacked on top of each other. The carrier can be clipped or otherwise conveniently attached to the side of a golf club bag or might be attached to a golf cart where a replacement ball can be conveniently reached.

The balls are biased upwardly by a spring within the tube which pushes the stack of balls upwardly toward the top. The carrier has a ball ejection opening at the side of the tube near its top from which a ball can be manually ejected. The carrier tube has a restricted top opening of size to block the release of the topmost ball of a stack of balls pushed upwardly in the tube. When desired, a golfer can cause a ball to be ejected from the side ejection opening by application of thumb or finger pressure exerted downwardly and laterally on the top ball and laterally toward the ejection opening. The ball is thereby released with a rolling action over the next underlying ball and can be readily received in the cupped hand of the golfer with which thumb pressure is applied for ejection of the ball.

An object of the invention is to provide a convenient easily carried container for golf balls.

Another object is to provide a compact and economical ball carrier adaptable to placement in any number of locations where a ball might be needed.

Another object of the invention is to provide a ball carrier from which a ball can be manually ejected easily as needed but which will hold in the remaining balls in the carrier securely during carriage.

A feature of the invention is the ease with which a ball can be removed from the carrier and the quick action release of the ball by simple finger manipulation on the top ball of the stack in the carrier.

Other objects and features which are believed to be characteristic of the invention are set forth in particularity in the appended claims. My invention, however, both in organization and manner of construction, together with further objects and features thereof maybe best understood by reference to the following description taken in connection with the accompanying drawings.

DETAILED DESCRIPTION

Figure 1:
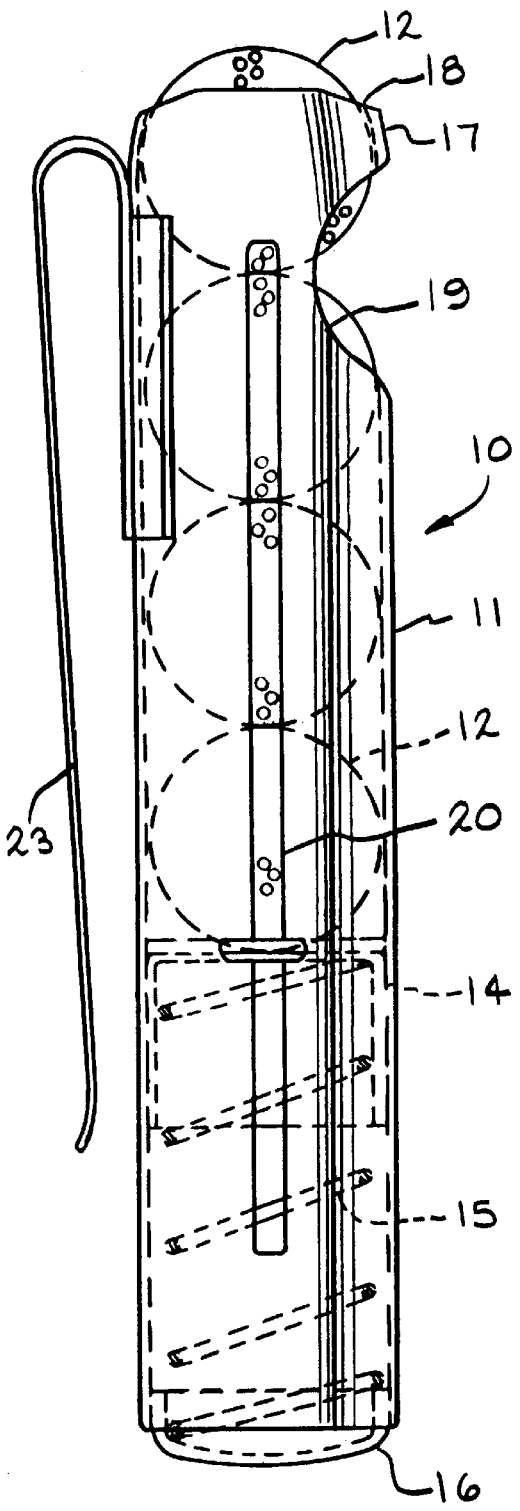
FIG. 1 is a side elevation partially see through illustration showing the ball carrier of this invention and the interior mechanism for holding the balls in stacked relation.
Figure 2:
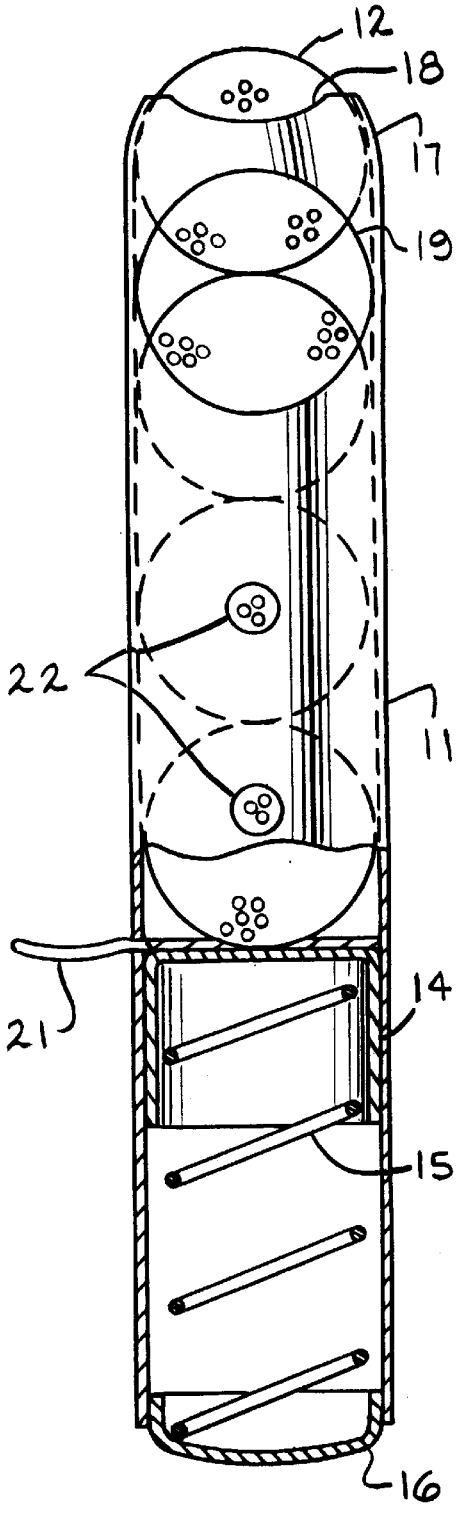
FIG. 2 is a front elevation view of the ball carrier of FIG. 1 partially in cross section illustrating the compression mechanism for holding the balls in stacked relation.

FIG. 1 illustrates the ball carrier 10 of this invention in which a tube 11 of length adequate to retain a desired number of balls is provided. The tube can be made of metal such as steel or aluminum or of plastic material. The diameter of the tube is slightly larger than the diameter of the balls to be contained therein to permit their free up and down movement within the tube. The balls 12 are pushed upwardly by an inverted cup-like piston 14 having lateral dimensions such that it can also be moved freely up and down within the tube interior. A helical spring 15 which pushes upwardly from the bottom 16 of the tube fits into the underside of the piston 14 to bias the series of balls contained in the carrier upwardly toward the top 17 of the carrier. The tube has at the top 17 an opening 18 of dimension smaller than that of a ball such that it restrains release of the top ball 12 in the contained stack. The dimension of the top opening 18 is defined by the marginal edges of the top which are in a sense flared or turned over toward the center of the tube to provide curved interior surfaces matching the radius of the balls thereby conformably holding the topmost ball in the stacked series free to be moved when desired. The ball ejection opening 19 from which a ball can be released from the tube is provided in the side of the tube just below the top 17. The opening 19 as can be seen in the frontal view shown in FIG. 2 is slightly elliptical with a slightly larger vertical to lateral dimensions and is adequate in such dimensions to allow a ball to pass freely therethrough upon being pushed from the tube end 18 toward the opening 19.

A narrow slot 20 extending lengthwise of the tube from a region near the top to a region near the bottom serves two functions. A push lever 21 fastened to the piston 14 is arranged to extend through the slot to permit the piston 14 to be moved downwardly against the pressure of the spring 15 by application of downward finger pressure on the lever 21. The lever 21 extends from a disk fixedly secured to the top of the piston 14. The disk can be provided a slight central depression to facilitate centering of a ball placed thereon. The piston 14 is made to have a depth such that it does not expose the spring 15 when it is in its uppermost position as determined by the upper limit of movement of the lever 21 in the slot 20.

To load the tube with a stack of balls, the piston is moved downwardly by application of pressure to the push lever 21 whereupon the balls can be fed into the opening 19. As many balls can be inserted as the tube is designed for. In most cases it is found that a stack of five balls in the tube is sufficient to permit playing of a full game of golf without requiring a recharge. As the piston 14 is held downwardly by pressure applied to the lever 21, as many balls as desired can be inserted one by one in the opening. Thereupon the lever 21 can be released to push the balls upwardly to a position where the topmost ball is partially visible in the opening 18.

The ball outlet opening 19, as can be seen in FIG. 1, is positioned to extend from a region near the middle of the second upper ball in the stack to a position just about half way up from the bottom of the uppermost ball. Thus when the balls are retained in the tube, the chance of an accidental release of a ball from the tube is unlikely.

A holding clip 23 fastened to the side of the tube 11 opposite the opening 19 is designed to extend downwardly for a distance to allow the carrier to be held conveniently in any number of locations such as at the marginal edge of a golf bag or on the framework of a golf cart.

As may be seen in FIG. 2, a series of small openings or apertures 22 allow viewing of the balls stacked in the tube to indicate the number of balls available. Similarly the slot 20 in a right angular position relative to the apertures 22 also permits viewing of the number of balls in the stack available for use.

Figure 3:
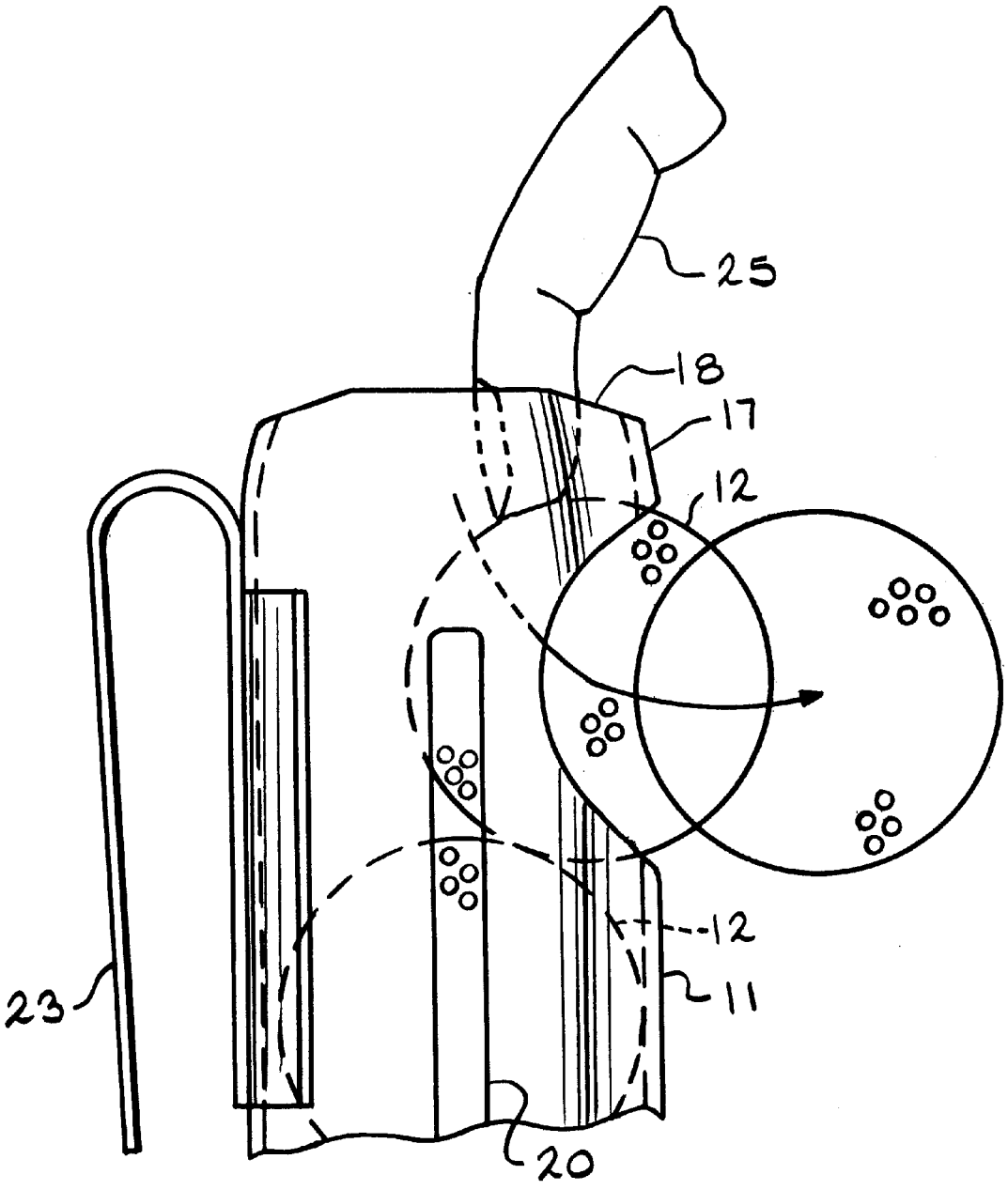
FIG. 3 is an enlarged illustration of the top of the carrier of FIGS. 1 and 2 illustrating how a ball is ejected from the carrier by application of downward lateral finger pressure to the top ball of the stack.

FIG. 3 illustrates the unique feature of applicant's invention whereby a topmost ball in the stack of balls within the carrier 10 can be pressed downwardly and laterally toward the exist opening 19 but in doing so the ball being pushed is rolled over the underlying ball 12 in the stack. The top ball thus in a sense is flipped out of the opening 19. That is the uppermost ball in being pushed laterally even a slight amount is positioned off center over the curved surface of the underlying ball leading toward the ejection opening. The upward force of the underlying spring biased ball thereby assists in pushing or squeezing the ball outwardly from the opening 19. That is the pushing action of the underlying second ball helps in ejection of the topmost ball.

Thus besides holding the stack of balls stably in the carrier against accidental release by pushing the balls upwardly to the opening 18, the invention allows easy removal of the topmost ball by mere application of finger pressure. In other words pushing the topmost ball downward and laterally toward the opening 19 causes it to roll over the curve of the underlying ball leading it to the exit opening 19 whereby the ball is assisted in its release. If thumb pressure is used the golfer's hand can be cupped under the opening 19 for ready receipt of the ball being ejected. After ejection of the desired uppermost ball, the next underlying ball 12 is pushed upwardly into the opening 18 by the lower balls in the stack. The new topmost ball thus becomes exposed at the opening 18 in similar fashion and is made ready as the next ball for manual release through the ejection opening 19.

As a variation of the invention a smaller carrier for conveniently holding two or three balls can be provided which can be made readily adaptable to being carried on a golfer directly, such as by being hung on a pants belt.

As another variation, if desired, the top surface of the piston 14 can be made with an inclination toward the side of the tube 11 in which the opening 19 is located. By so doing the last ball in the tube will be assisted out of the opening 19 without presence of an underlying ball over which it might otherwise roll over.

Although the invention is herein described in relation to containment of golf balls, it will be readily recognized by those skilled in the art that other balls as well can be contained and carried in similar fashion. For example, the system lends itself admirably for use in containing and carrying tennis balls.

In view of the foregoing it will be understood that many variations of the arrangement of the invention can be provided within the broad scope of the principles embodied therein. Thus, while a particular preferred embodiment of the invention has been shown and described herein, it is intended by the appended claims to cover all such modifications which fall within the true spirit and scope of the invention.

What is claimed is:

1. A ball carrier and dispenser comprising a cylindrical tube of diameter slightly larger than balls to be carried, said tube being of length to accommodate a plurality of said balls in stacked relation, a ball support member reciprocally movable within said tube into supporting contact with the lowermost ball of a stack of balls in said tube, a spring based at the bottom of said tube arranged to bias said support member upward into supporting contact with the lowermost ball to push said stack of balls upwardly in said tube, an open end at the top of said tube, said open end being smaller in size than the balls to be contained therein, thereby to restrain passage of a ball therethrough, a ball dispensing opening in the side of said tube below said open end through which a ball can be released from said tube, said open end being of size to permit application of the force of a person's finger against the topmost ball downward and toward said dispensing opening to effect release of a ball from said stack through said dispensing opening.

2. A ball carrier and dispenser as set forth in claim 1 in which a slot is provided extending from the bottom region of said tube to near its top through which the number of balls stacked in said tube is visible.

3. A ball carrier and dispenser as set forth in claim 2 in which a push lever connected to said ball support member extends through said slot to the exterior of said tube to permit manual application of pressure thereagainst and correspondingly against said spring to move said ball support member toward the bottom of said tube.

4. A ball carrier and dispenser as set forth in claim 1 in which the margin of the open end at the top of said tube extends curvalinearly over the interior of said tube to permit receipt of the topmost ball in the tube in matched conformity with its diameter.

5. A ball carrier and dispenser as set forth in claim 1 in which said ball dispensing opening is aligned to extend above the bottom of the topmost ball in said stack and down to about the mid region of a ball next in line under the topmost ball.

6. A ball carrier and dispenser as set forth in claim 5 in which said ball dispensing opening is elliptical with a slightly larger vertical dimension than lateral dimension.

7. A ball carrier and dispenser as set forth in claim 1 in which said ball support member is secured to the top of an inverted cylindrical cup of dimension to interiorly accommodate the upper end of said spring.

8. A ball carrier and dispenser as set forth in claim 7 in which said cylindrical cup is of length such that it blocks the view of said spring at said dispensing opening when a single ball alone is at said tube end.

9. A ball carrier and dispenser as set forth in claim 8 including a ball viewing slot extending from the bottom region of said tube to near the top of said tube a distance from said top a bit less than but about the diameter of a ball, whereby said spring is hidden at said dispensing opening by said cup when balls are not present in said tube.

10. A ball carrier and dispenser as set forth in claim 1 in which a series of spaced viewing apertures are provided in a side of said tube to permit viewing of the number of balls present in said tube.

11. A ball carrier and dispenser as set forth in claim 1 in which said ball support member is inclined slightly toward the side of said tube where said dispensing opening is located.

12. A ball carrier and dispenser comprising a cylindrical tube of diameter slightly larger than balls to be carried therein, said tube being of length to accommodate a plurality of said balls in stacked relation, biasing means in the lower region of tube arranged to push said balls upwardly in said tube, said tube having an open end smaller in dimension than the diameter of balls contained in said tube to which the topmost of the stacked balls is pushed in biased relation, a ball dispensing opening in the side of said tube below and adjacent to said open end through which said topmost ball can be released by application of finger pressure through said open end downwardly and toward said dispensing opening.

13. A ball carrier and dispenser as set forth in claim 12 in which said biasing means comprises a piston having a ball contacting top surface and a spring below said piston biasing said piston and balls stacked thereover toward said open end.

14. A ball carrier and dispenser as set forth in claim 12 in which a slot is provided extending from the lower region of said tube to near its top through which the number of balls stacked in said tube is visible.

15. A ball carrier and dispenser as set forth in claim 13 in which a push lever connected to said piston extends through said slot to the exterior of said tube to permit manual application of pressure thereagainst and against said biasing spring to move said piston toward the bottom of said tube.

16. The method of containing and dispensing a series of balls one at a time from a ball carrier comprising, stacking a series of balls in a channel, biasing said balls to an end of the channel, restraining the release of said balls at said channel end, providing a ball dispensing opening in the side of said channel adjacent to said channel end, providing an opening at said channel end, for application of downward pressure on the endmost ball against the biasing action on the balls and laterally toward the dispensing opening whereby said endmost ball is moved toward said opening and rolled over the next ball in the stack and out of said side opening under influence of the downward pressure and opposite biasing action on said balls.

* * * * *